United States Patent [19]

Kruger

[11] 4,229,745

[45] Oct. 21, 1980

[54] EDGE SLOTTED WAVEGUIDE ANTENNA ARRAY WITH SELECTABLE RADIATION DIRECTION

[75] Inventor: Bradford E. Kruger, Woodland Hills, Calif.

[73] Assignee: International Telephone and Telegraph Corporation, New York, N.Y.

[21] Appl. No.: 34,399

[22] Filed: Apr. 30, 1979

[51] Int. Cl.[3] ..... H01Q 13/10

[52] U.S. Cl. ..... 343/771; 343/768

[58] Field of Search ..... 343/768, 771, 770, 767

[56] References Cited

U.S. PATENT DOCUMENTS

| | | | |
|---|---|---|---|
| 2,803,008 | 8/1957 | Lindenblad | 343/770 |
| 3,969,729 | 7/1976 | Nemit | 343/768 |
| 4,035,807 | 7/1977 | Tang et al. | 343/768 |

*Primary Examiner*—David K. Moore

*Attorney, Agent, or Firm*—William T. O'Neil

[57] ABSTRACT

An antenna array consists of one or more slotted-waveguide, linear subarrays. Slots for radiation are cut in both narrow walls of each such waveguides, and PIN diodes across the slots are selectably forward and backward biased to effectively open the slots along one waveguide narrow wall while the others are closed and, alternatively, vice verse.

10 Claims, 7 Drawing Figures

FIG. 5
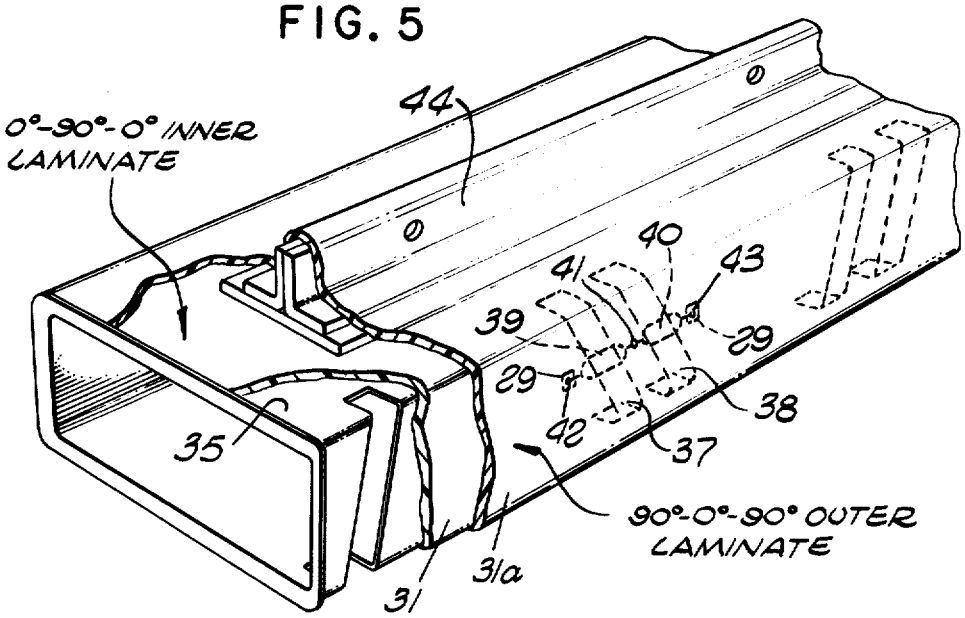
FIG.6
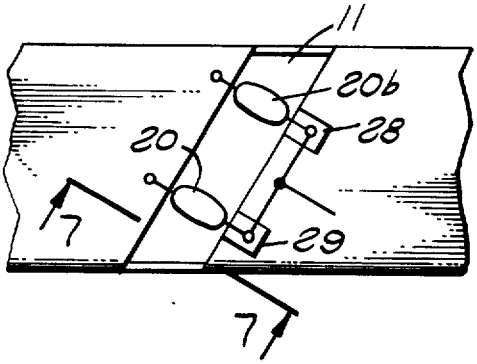
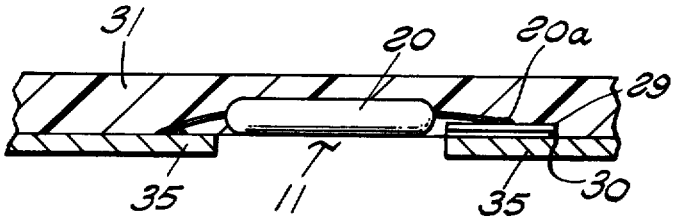
FIG. 7

EDGE SLOTTED WAVEGUIDE ANTENNA ARRAY WITH SELECTABLE RADIATION DIRECTION

BACKGROUND OF THE INVENTION

1. Field of the Invention

The invention relates to microwave antennas generally and to slotted waveguide arrays more particularly.

2. Description of the Prior Art

In the prior art, the edge-slotted waveguide antenna is well-known. Such an antenna may be used singly as a linear array providing a beam sharpened in a single coordinate, or a number of such linear arrays may be stacked to form a planar array. Planar arrays of that type are shown and described in the Patent and Technical Literature. For example, in the text "Radar Handbook" by Merrill I. Skolnik (McGraw-Hill, 1979 (, planar arrays are illustrated in Chapter 13 thereof, especially in FIGURE 15, 27, 29 and 30 in that chapter.

A dual-slot version of the slotted-waveguide antenna is described in U.S. Pat. No. 3,740,751 entitled "Wideband Dual-Slot Waveguide Array" assigned to the assignee of the present application. As this description proceeds, it will be seen that the present invention is adaptable to either the single or dual-slot version.

Still further, U.S. Patent application, Ser. No. 942,070, filed Sept. 13, 1978, entitled "Lightweight Composite Slotted-Wageguide Antenna and Method of Manufacture" assigned to the assignee of the present application describes a type of composite "built-up" plastic material structure in which the slots of an array are covered by a relatively heavy electrically transparent material which acts as a radome for environmental protection of the interior of the waveguide and also as a structural material. The manner in which the present invention can ideally be applied in a planar array constructed according to U.S. Pat. No. 3,740,751, or the aforementioned patent application, Ser. No. 942,070, will be appreciated as this description proceeds.

The concept of constructing an array from which a narrow beam can be produced from a "front" plane and alternatively from a "rear" plane or aperture is not new in the broadest sense. One example is the apparatus described in U.S. Pat. No. 4,044,360 entitled "Two-Mode RF Phase Shifter" "Particularly for Phase Scanner Array." In that patent, a planar array has front and back apertures and if illuminated from the rear aperture can act as a scanable lens comprising a plurality of phase programmed individual elements in the planar array configuration. Alternatively, that device can be operated in a reflective mode in which the array reflects the primary feed energy, (such as a "dish" reflector would do), likewise in a programmable phase pattern for scanning purposes.

The present invention provides a relatively low-cost arrangement for alternative front and rear aperture operation. The manner in which the state of the prior art is advanced by the invention will be understood as this description proceeds.

The recognized problem of maximizing scanning coverage in many radar applications will be seen to be relieved substantially when the system of the invention is employed.

SUMMARY

The invention comprises an array of the slotted-waveguide type, the slots being placed in both narrow walls of the waveguide or waveguides. The slots of either side are essentially opened or closed in accordance with the non-conducting or conducting condition of RF diodes placed at least one to a slot across the slot orthogonally. In this way an array may be rapidly switched between "front looking" and "rear looking modes" of operation. Accordingly, the general objective of providing for rapid 180° scan direction switching for greater coverage of a surveillance volume of space without resorting to full back-to-back arrays is served. It will be seen that the antenna system according to the invention is lighter, simpler, and inherently less expensive than prior art apparatus for accomplishing the same functions.

The structure of the invention lends itself ideally to application in plastic-buildup, slotted-waveguide array structures such as described in the aforementioned U.S. Application, Ser. No. 942,070, since the radio frequency (PIN Type) diodes used are available in a form factor permitting their embedment in the plastic material of the overall structure. In U.S. Pat. No. 3,740,751 the conductive wave-guide walls are relatively thin metallic films on the inner surfaces of the guides and the plastic build-up over the outside of these waveguides serves both structural and environmental protection (radome) functions. The details of a typical embodiment of a slotted-waveguide arrays applying and incorporating the present invention will be described hereinafter.

BRIEF DESCRIPTION OF THE DRAWINGS

FIG. 5 illustrates a dual slot version of the slotted wave-guide array also incorporating the composite laminate technique.

FIG. 6 is a schematic diagram illustrating an alternative control diode configuration in which two diodes per slot are employed.

FIG. 7 is a view of a typical radio frequency diode in place with control connections and radio frequency by-passing means.

DETAILED DESCRIPTION

Figure 1:
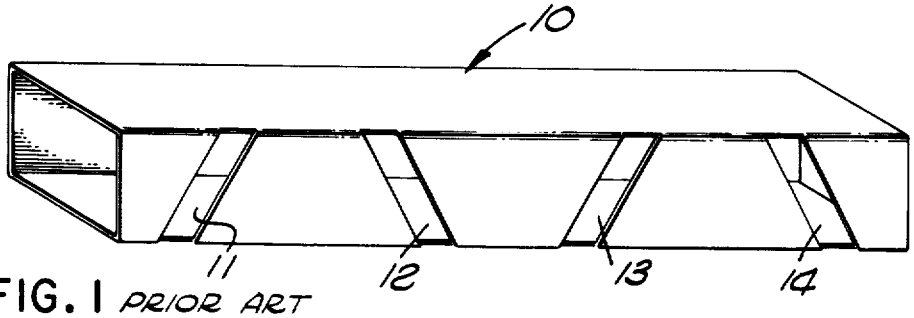
FIG. 1 PRIOR ART
FIG. 1 is an outline drawing of a typical prior art slotted-waveguide, linear array suitable for incorporation in a planar array.

Referring now to FIG. 1, a more or less typical slotted-waveguide, linear array is depicted. As aforementioned, such arrays are well-known in the prior art. Examples of the technical literature pertinent thereto have been identified herein before.

Figure 2:
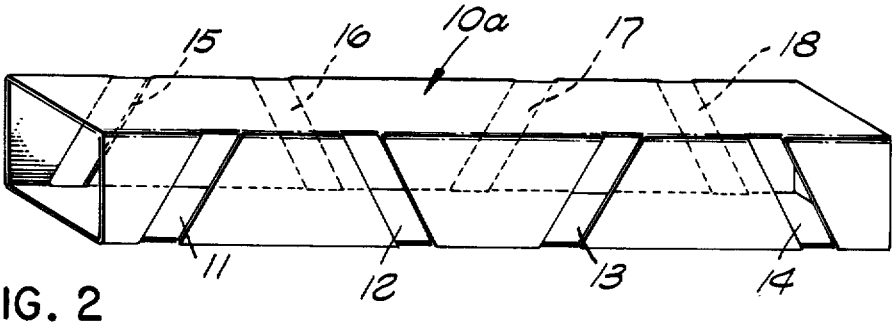
FIG. 2 depicts the same slotted-waveguide array of FIG. 1 except that slots are also provided in the opposite narrow wall.

Referring now to FIG. 2, a slotted-waveguide array 10-A having the same alternatively angled slots, 11, 12, 13 and 14 as the slotted waveguide device 10-A of FIG. 1, is shown. In addition, the slotted waveguide 10-A of FIG. 2 has opposite slots 15, 16, 17 and 18 in the opposite narrow guide wall.

Figure 3:
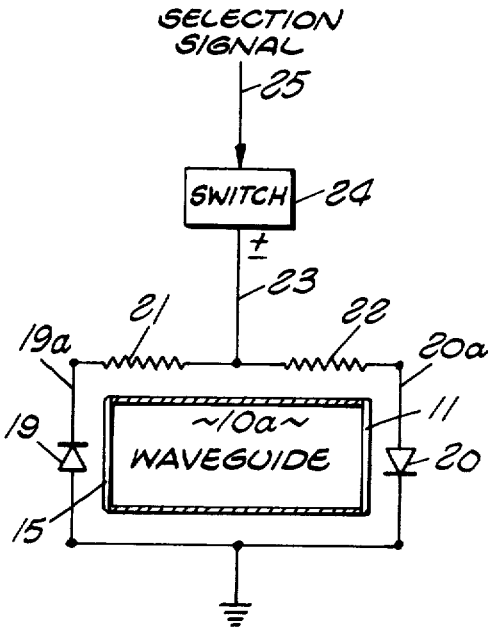
FIG. 3 is a schematic depicting a typical control arrangement for selecting radiation/reception from one narrow wall of the waveguide or the other.

Referring now to FIG. 3, an end-on view of waveguide 10-A with schematically represented diodes and control circuit is shown. One pair of opposite waveguide slots as depicted in FIG. 2, i.e., slots 11 and 15, are depicted as non-cross-hatched in this end-on view of waveguide 10-A. The ground connection illustrated can be the metal of the waveguide itself or of the inner conductive layer in a composite waveguide structure as will be more clearly hereinafter shown.

Figure 4:
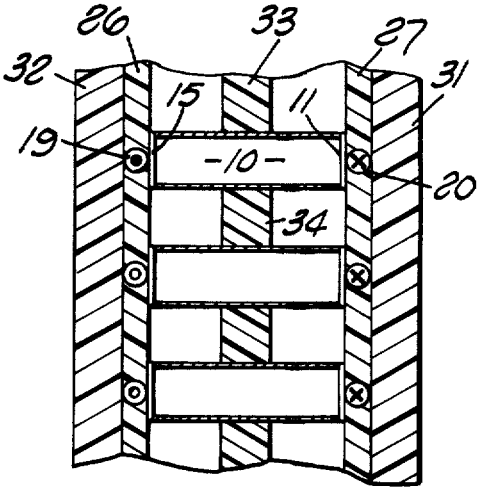
FIG. 4 illustrates a representive mechanical structure for incorporation of the waveguide linear arrays according to the invention using composite laminate type structures to produce a planar array with front and back apertures.

FIG. 4 like FIG. 3 is an end view of an assembly of three waveguides according to FIGS. 2 and 3. The "front" and "back" diodes are depicted as circle dots (19) and circle crosses (20) to illustrate their opposite orientation across each slot. For purposes of fabrication, a plastic laminate sheet such as 26 and 27 might be fabricated as a "lay-up" with embedded radio frequency (PIN Type) diode specifically 19 and 20 corresponding to FIG. 3, for example. The locations for these diodes in the lay-up would be such that they would extend at right angles across the (width dimension of the) slots. A plurality of stiffener members, particularly 33 and 34 are laid lengthwise for at least the full length dimension of each of the slotted waveguides. In assembling the waveguides in place, provisions must be made for the electrical connections to the diodes, a typical configuration in that regard being shown hereinafter in FIGS. 5, 6 and 7. In FIG. 4, a final step might be the application of a further laminate composite structure such as 31 and 32 which might enclose the entire front and back planes of the planar array, or could be applied to only extend in vertical bands between the slot locations. In any event the laminate structure could enclose the top and bottom and provide appropriate external mounting hardware.

Referring now to FIG. 5, a dual-slot waveguide configuration is depicted. Constructed in accordance with the composite laminate structure described in the aforementioned patent application, Ser. No. 942,070. In FIG. 5, each of the dual slots at each slot location must each have its own diode. For typical slots 37 and 38 illustrated in FIG. 5, diodes 39 and 40 are shown embedded in the inner laminate and if necessary in the outer laminate to accommodate their dimensions. The diodes are grounded at 41 as each diode would be in a single-slot configuration. Thus, the waveguide wall (in the case of FIG. 5 the layer of 35), becomes the control signal ground return.

The leads to the other ends of diodes 39 and 40, namely leads 42 and 34, receive the plus or minus control voltage in accordance with FIG. 3. Since both slots of the dual-slot version, namely slots 37 and 38, are to be opened and closed at the same time and under the same circumstances, leads 42 and 43 would be essentially parallel through an appropriate series resistor to a switch such as 24 in FIG. 3.

The laminates illustrated in FIG. 5 (31 and 35) are laid up as 0°-90°-0° and 90°-0°-90° laminates as set forth in the aforemention Patent Application Ser. No. 942,070. The stiffending and mounting rib 44 is typical, and adaptable to the structure of FIG. 4, in lieu of the longitudinal structure member 33 and 34 by exercise of ordinary skill of the particular art.

FIG. 5 depicts a pair of by-passed capactiors 29 which are also shown in FIG. 6 and 7 for more detail. Looking ahead to FIG. 7, a typical RF (PIN Type) diode 20 is shown across slot labeled 11. One lead of the diode 20 will be seen to be electrically and mechanically fixed to the conductive layer 35 and the other end extends into a control lead 20-A. This control lead 20-A is also depicted on FIG. 3 as is control lead 19-A for the corresponding diode 19. The samll by-pass compacitor at the 20-A end of the diode 20 may be merely a small plate 29 separated from the conductive layer 35 by a thin layer of dielectric 30. Such a by-pass capacitor shortens the radio frequency short-circuit pack around any given slot when the diode is forwrd biased to effectively close the corresponding slot.

It will be realized that the fraction of the total transmitted power in a planar array which passes through a given slot in a given slotted-waveguide is a relatively small fraction of the total system power. Accordingly, the power handling capability of diodes such as 20 or 39 and 40 in FIG. 5 need not be great even though the total antenna excitation power is relatively high.

Returning to FIG. 6, an alternative form of diode arrangement is indicated wherein two diodes essentially electrically paralled, are in place across each slot. Thus, for the dual slot version of FIG. 5, four diodes would be required per dual slot location. Such a configuration provides more effective slot "closing" in one mode but introduces additional blockage or disturbance of the filed emanating from or being received by a given slot. The result is at least some aggravation of spatial side lobes, however with judicious selection of slot spacing and other array design parameter, the side lobes can normally be held within acceptable limits.

Looking down on capacitor blocks 28 and 29 in FIG. 6, it will be recognized that separate by-pass capacitors for minimum RF current path length across the slots in the diode conducting mode (slots closed) would be desirable. These capacitor units would each be essentially as contemplated in FIG. 7.

Modifications and variations within the scope of the invention will suggest themselves to those skilled in this art, once the principles of the invention are thoroughly understood. Accordingly, it is not intended that the drawings or this description should be considered as limiting the scope of the invention, these being intended to be typical and illustrative only.

What is claimed is:

1. An antenna array comprising at least one slotted-waveguide having a first predetermined slot pattern in a first of its narrow walls and a second predetermined pattern of slots in its second narrow wall comprising:

means comprising first and second sets of radio frequency diodes, said first set comprising at least one diode for each slot in said first slot pattern and said second set comprising at least one diode for each slot in said second slot pattern;

and means for controlling said diodes alternatively into conduction and non-conduction by sets such that said slots in said first pattern are effectively alternatively closed and open while said slots of said other set are contemporaneously alternatively opened and closed, respectively, said diodes each being placed across a corresponding slot so as to provide substantially a radio frequency short-circuit during its conductive condition and substantially no effect on said slot in said non-conductive conditions.

2. Apparatus according to claim 1 in which a plurality of said slotted-waveguides is stacked to form a planar array, said first diode set thereby comprising a diode for each slot in said first slot pattern over a first aperture of said planar array, said diodes each being placed substantially orthogonally with respect to the greatest dimension of a corresponding slot.

3. Apparatus according to claim 1 in which said diodes are PIN Type diodes.

4. Apparatus according to claim 2 in which said diodes are PIN Type diodes.

5. Apparatus according to claim 1 in which said means for controlling said diodes comprises means for alternatively biasing said diodes of said second set into conduction and said diodes of said first set into non-conduction to effect operation of said array from said second aperture.

6. Apparatus according to claim 1 in which said diodes are connected at one end to said waveguide adjacent a first edge of the corresponding slot and to a source of biasing at the other end.

7. Apparatus according to claim 6 further including a by-pass capacitor connected from said other end of said diode to a point adjacent a second edge of said corresponding slot to provide a short radio frequency path across said slot during conduction of said diode, said second end of said diode being extended into a control signal lead to said means for controlling said diodes by sets.

8. Apparatus according to claim 4 in which said diodes are connected at one end to said waveguide adjacent a first edge of the corresponding slot and to a source of biasing at the other end.

9. Apparatus according to claim 8 further including a by-pass capacitor connected from said other end of said diode to a point adjacent a second edge of said corresponding slot to provide a short radio frequency path across said slot during conduction of said diode, said second end of said diode being extended into a control signal lead to said means for controlling said diodes by sets.

10. Apparatus according to claim 1 further defined in that there are at least two of said diodes across each of said slots and in that said means for controlling said diodes is connected to control said two diodes in parallel.

* * * * *